US009822659B2

(12) United States Patent
Arikawa et al.

(10) Patent No.: US 9,822,659 B2
(45) Date of Patent: Nov. 21, 2017

(54) GAS TURBINE WITH HONEYCOMB SEAL

(71) Applicant: Mitsubishi Hitachi Power Systems, Ltd., Yokohama, Kanagawa (JP)

(72) Inventors: Hideyuki Arikawa, Yokohama (JP); Tadashi Kasuya, Yokohama (JP); Yoshitaka Kojima, Yokohama (JP); Yasuyuki Watanabe, Yokohama (JP); Tadashi Murakata, Yokohama (JP); Kunihiro Ichikawa, Yokohama (JP); Takumi Konrai, Yokohama (JP)

(73) Assignee: Mitsubishi Hitachi Power Systems, Ltd., Yokohama (JP)

( * ) Notice: Subject to any disclaimer, the term of this patent is extended or adjusted under 35 U.S.C. 154(b) by 455 days.

(21) Appl. No.: 14/289,188

(22) Filed: May 28, 2014

(65) Prior Publication Data

US 2014/0356142 A1 Dec. 4, 2014

(30) Foreign Application Priority Data

May 29, 2013 (JP) ..... 2013-113415

(51) Int. Cl.
*F01D 11/12* (2006.01)

(52) U.S. Cl.
CPC ..... *F01D 11/127* (2013.01); *F05D 2250/283* (2013.01)

(58) Field of Classification Search
CPC ..... F01D 11/00; F01D 11/001; F01D 11/12; F01D 11/122; F01D 11/127; F01D 11/14;
(Continued)

(56) References Cited

U.S. PATENT DOCUMENTS 3,365,172 A * 1/1968 Howald ..... F01D 11/08 277/414
3,649,033 A 3/1972 Kondo
(Continued)

FOREIGN PATENT DOCUMENTS

CN 201884072 U 6/2011
CN 201943757 U 8/2011
(Continued)

OTHER PUBLICATIONS

Machine Translation of DE 102005002270 [retrieved on Jul. 19, 2016]. Retrieved from: Espacenet.*
(Continued)

*Primary Examiner* — Woody Lee, Jr.
*Assistant Examiner* — Eric Zamora Alvarez
(74) *Attorney, Agent, or Firm* — Crowell & Moring LLP

(57) ABSTRACT

A gas turbine includes a compressor, a combustor, and a turbine. The turbine includes a honeycomb seal disposed so as to be secured to a casing side in a clearance between the casing and turbine blades rotating around a rotating shaft and a seal fin that is provided on an end face of each of the turbine blades facing the honeycomb seal. The seal fin extends in a direction perpendicular to the rotating shaft. The honeycomb seal is formed by a plurality of corrugated sheet metals overlapped with each other at walls of nodes thereof and the walls of the nodes are blazed with each other. Each of the corrugated sheet metals has trapezoids formed in alternating fashion. A longer direction of each wall of the nodes of the honeycomb seal is angled with respect to the rotational direction of the turbine blades.

5 Claims, 8 Drawing Sheets

(58) Field of Classification Search
CPC ..... F01D 5/12; F01D 5/14; F01D 5/20; F01D 9/04; F02C 7/28; F05D 2240/11; F05D 2240/307
See application file for complete search history.

(56) References Cited

U.S. PATENT DOCUMENTS

| | | | | |
|---|---|---|---|---|
| 4,623,298 | A * | 11/1986 | Hallinger | F01D 11/12 415/139 |
| 4,832,999 | A | 5/1989 | Sweet | |
| 4,884,820 | A * | 12/1989 | Jackson | C21D 1/09 277/415 |
| 5,520,508 | A * | 5/1996 | Khalid | F01D 11/08 415/119 |
| 6,120,242 | A | 9/2000 | Bonnoitt et al. | |
| 6,251,494 | B1 | 6/2001 | Schreiber | |
| 6,575,698 | B2 * | 6/2003 | Beeck | F01D 11/127 415/173.4 |
| 6,881,029 | B2 * | 4/2005 | Le Biez | F01D 5/145 415/119 |
| 2002/0015641 | A1 | 2/2002 | Beeck et al. | |
| 2002/0110451 | A1 | 8/2002 | Albrecht, Jr. et al. | |
| 2008/0292466 | A1 | 11/2008 | Tragesser et al. | |
| 2009/0304520 | A1 * | 12/2009 | Brittingham | F01D 5/187 416/97 R |
| 2012/0269638 | A1 * | 10/2012 | Dyer | F01D 5/20 416/223 R |

FOREIGN PATENT DOCUMENTS

| | | | | |
|---|---|---|---|---|
| CN | 201943758 | U | 8/2011 | |
| DE | 102005002270 | A1 * | 7/2006 | F01D 11/127 |
| EP | 0 716 218 | A1 | 6/1996 | |
| EP | 1 001 140 | A2 | 5/2000 | |
| EP | 1 179 654 | A2 | 2/2002 | |
| GB | 793 886 | A | 4/1958 | |
| JP | 46-23525 | B | 7/1971 | |
| JP | 2001-123803 | A | 5/2001 | |
| JP | 2002-309902 | A | 10/2002 | |
| JP | 2005-163693 | A | 6/2005 | |
| JP | 2008-291846 | A | 12/2008 | |
| JP | 2010-196797 | A | 9/2010 | |
| JP | 2011-226559 | A | 11/2011 | |
| JP | 2013-19507 | A | 1/2013 | |
| WO | WO 2006/076881 | A1 | 7/2006 | |

OTHER PUBLICATIONS

Machine Translation of JP 2011-226559 A [retrieved on Jul. 19, 2016]. Retrieved from: Japan Platform for Patent Information.*
Chinese Office Action issued in counterpart Chinese Application No. 201410228340.X dated Feb. 1, 2016 (eleven (11) pages).
Chinese Office Action issued in counterpart Chinese Application No. 201410228340.X dated Jun. 24, 2015 with partial English translation (eight pages).
European Search Report dated Nov. 19, 2014 (10 pages).
Chinese Office Action issued in counterpart Chinese Application No. 201410228340.X dated Aug. 16, 2016 with English-language translation (twenty-two (22) pages).
Japanese Office Action issued in counterpart Japanese Application No. 2013-113415 dated Feb. 14, 2017 with English translation (eight (8) pages).

* cited by examiner

GAS TURBINE WITH HONEYCOMB SEAL

BACKGROUND OF THE INVENTION

1. Field of the Invention

The present invention relates to a gas turbine that is provided with an abradable honeycomb seal installed to reduce the leakage of working fluid from a clearance between turbine blades and a casing.

2. Description of the Related Art

In a gas turbine mainly including a compressor, a combustor, and a turbine, high-temperature combustion gas flows between turbine blades installed on a rotating shaft and stator vanes installed on a stationary casing side. It is desirable to prevent the combustion gas from leaking from the turbine blade tip clearance in terms of the performance of the turbine. To meet such request, a gas turbine provided with an abradable honeycomb seal secured to the casing side is generally used. This honeycomb seal is manufactured in the following manner: a thin sheet metal is processed to form a corrugated shape in which trapezoids are alternately continued; a plurality of the corrugated thin sheet metals are overlapped at their walls of node, the walls of node being brazed with each other; and the abradable honeycomb seal provided with a number of approximately hexagonal voids are manufactured.

FIG. 7 is a schematic view exemplifying a seal structure located at the tip of a gas turbine blade B using an abradable honeycomb seal H. The honeycomb seal H is secured to a shroud S on a casing C side at a portion facing a seal fin F installed on the tip of the rotating turbine blade B. A clearance between the tip of the seal fin F and the honeycomb seal H is maintained as little as possible. The leakage of combustion gas at the tip of the turbine blade B is accordingly suppressed.

As illustrated in FIG. 8, the whole of the honeycomb seal H is generally configured as follows: a corrugated thin sheet metal P is processed such that trapezoids are alternately continued; a plurality of the corrugated thin sheet metals P are overlapped at their walls of node K; and the walls of node K are brazed with each other (at the brazed places R) so that the corrugated thin sheet metals P are secured to each other.

The honeycomb seal H is formed of a material relatively softer than the turbine blade B. The honeycomb seal H comes into contact with the rotating turbine blade B when the rotating turbine blade B extends in the radial direction perpendicular to the rotational axis due to thermal expansion. As a consequence, the honeycomb seal H is easily abraded by the seal fin F arranged on the tip of the turbine blade B. Accordingly, while avoiding the damage and vibration of the turbine blade B, the clearance between the turbine blade B and the honeycomb seal H is kept constant whereby the leakage of combustion gas is suppressed.

Incidentally, as regards the securing of the honeycomb seal H to the shroud S on the casing C side, as illustrated in FIG. 8, the honeycomb seal H is generally secured to the shroud S via the brazed place R in such a manner that the longer direction of the wall of node K (also the longer direction of the brazed place R extending in the Y1 direction in FIG. 8) may coincide with the rotational direction (the Z direction in FIG. 8) of the turbine blade B. The reason of this securing method is as follows: the corrugated thin sheet metals P formed with press working or other methods are secured to the shroud S so as to extend in the rotational direction of the turbine blade B. Hence, the securing-workability of the corrugated thin sheet metals will be satisfactory and manufacturing efficiency will be enhanced.

However, in the securing configuration of the honeycomb seal H described above, the walls of node K and the brazed places R which are abraded when the seal fin F abrades the honeycomb seal H become larger in length. The abradability of the honeycomb seal H by the seal fin F will be degraded accordingly.

When the rotating seal fin F comes into a situation of contact with the brazed place R, the abradability of the honeycomb seal H by the seal fin F significantly lowers compared with the case of contact with only the corrugated thin sheet metal. In fact, the thickness of the seal fin F is equal to or greater than that obtained by addition of the thickness of the brazed place R to the thickness of the two walls of node K. The seal fin F therefore will simultaneously abrade the two walls of node K and the brazed place R between the walls along the longer direction.

As illustrated in FIG. 8, the brazed place R of the honeycomb seal H is linear because the wall of node K is one side of a trapezoid. The longer direction of the brazed place R and the sliding direction of the seal fin F along with the rotational direction of the turbine blade B (and the seal fin F) are almost the same direction. Thus, a distance becomes long in which the seal fin F comes into contact with and slides along the brazed place R with low abradability. In addition, the abradability of the honeycomb seal H by the seal fin F lowers because of the formation in which the longer direction of the brazed place R independently faces the slide of the seal fin F.

The seal fin F may be abraded by the brazed place R in some cases. With the seal fin F being abraded, the leakage of the combustion gas from the abraded portion increases, which directly leads to a decrease in the performance of the gas turbine.

SUMMARY OF THE INVENTION

As countermeasures to such problems, JP-2011-226559-A proposes a structure in which the brazed place of the honeycomb seal is limited to a portion on the base material side, so that a seal fin and the brazed place do not directly slide with each other. JP-2002-309902-A proposes a technology in which a material having a melting point lower than the softening temperature of a rotor blade material is used for a honeycomb seal.

However, these conventional technologies require a honeycomb seal having a special shape and material and have problems in terms of economic efficiency, abradability, and durability.

Also, JP-2005-163693-A discloses a sealing device in which a honeycomb wall cross-section, which is a cross-section of a wall of a honeycomb seal, extends in an obliquely inclined manner with respect to a honeycomb seal sectional line. This sectional line shows the cross-section of an envelope plane formed by the tip of the honeycomb seal.

The technology disclosed in JP-2005-163693-A aims to reduce a leakage amount of fluid between a stationary member and a rotating member. The technology is nothing but simply tilting the wall of the honeycomb seal rising up from the stationary member such as a casing. The technology fails to solve the above-described problem in which the seal fin of the turbine blade is abraded by the brazed places of the honeycomb seal.

The present invention has been made in view of the above problem and aims to provide a gas turbine that can solve the problem in which a seal fin of a turbine blade is abraded by the brazed places of a honeycomb seal.

In order to achieve the aforementioned aim, a gas turbine according to an aspect of the present invention comprises: a compressor, a combustor, and a turbine which includes a honeycomb seal disposed so as to be secured to a casing side in a clearance between a casing and a turbine blade rotating around a rotating shaft extending in a longitudinal direction of the casing, and a seal fin provided on an end face of the turbine blade facing the honeycomb seal, the seal fin extending in a direction perpendicular to the rotating shaft, wherein the honeycomb seal is formed by a plurality of corrugated thin sheet metals overlapped with each other at each wall of node, the wall of node being brazed with each other, each of the corrugated thin sheet metals having a trapezoid alternately continued, and wherein a longer direction of the wall of node of the honeycomb seal is tilted with respect to the rotational direction of the turbine blade.

The gas turbine according to the present invention is such that the longer direction of the wall of node of the corrugated thin sheet metal forming the honeycomb seal, that is, the longer direction of the brazed place whereby the walls of node are secured to each other is tilted with respect to the rotational direction of the turbine blade. The abradability of the honeycomb seal by the turbine blade and the seal fin can be improved and the abrasion of the seal fin by the honeycomb seal can be suppressed accordingly.

DESCRIPTION OF THE PREFERRED EMBODIMENTS

Preferred embodiments of a gas turbine according to the present invention will hereinafter be described with reference to the drawings.

[An Embodiment of a Gas Turbine]

<The Overall Configuration of the Gas Turbine>

Figure 1:
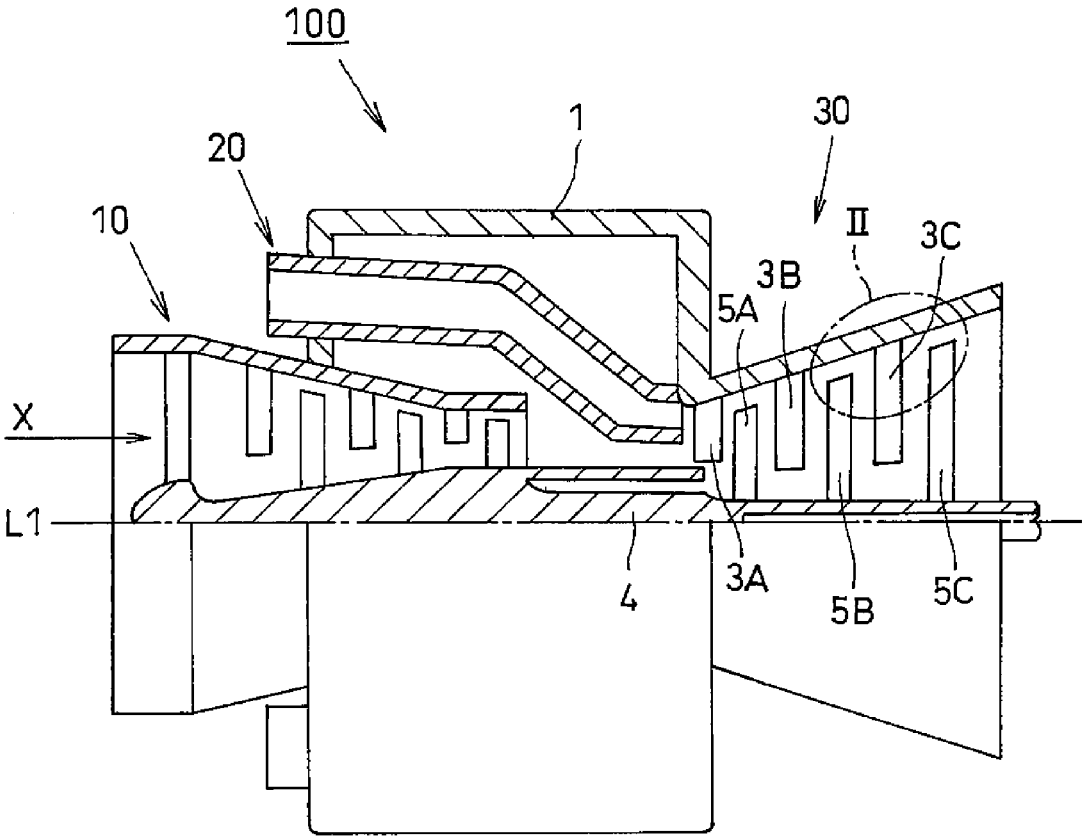
FIG. 1 is a schematic view illustrating the overall configuration of a gas turbine according to the present invention, its upper part above a centerline being illustrated in longitudinal cross-section.
Figure 2:
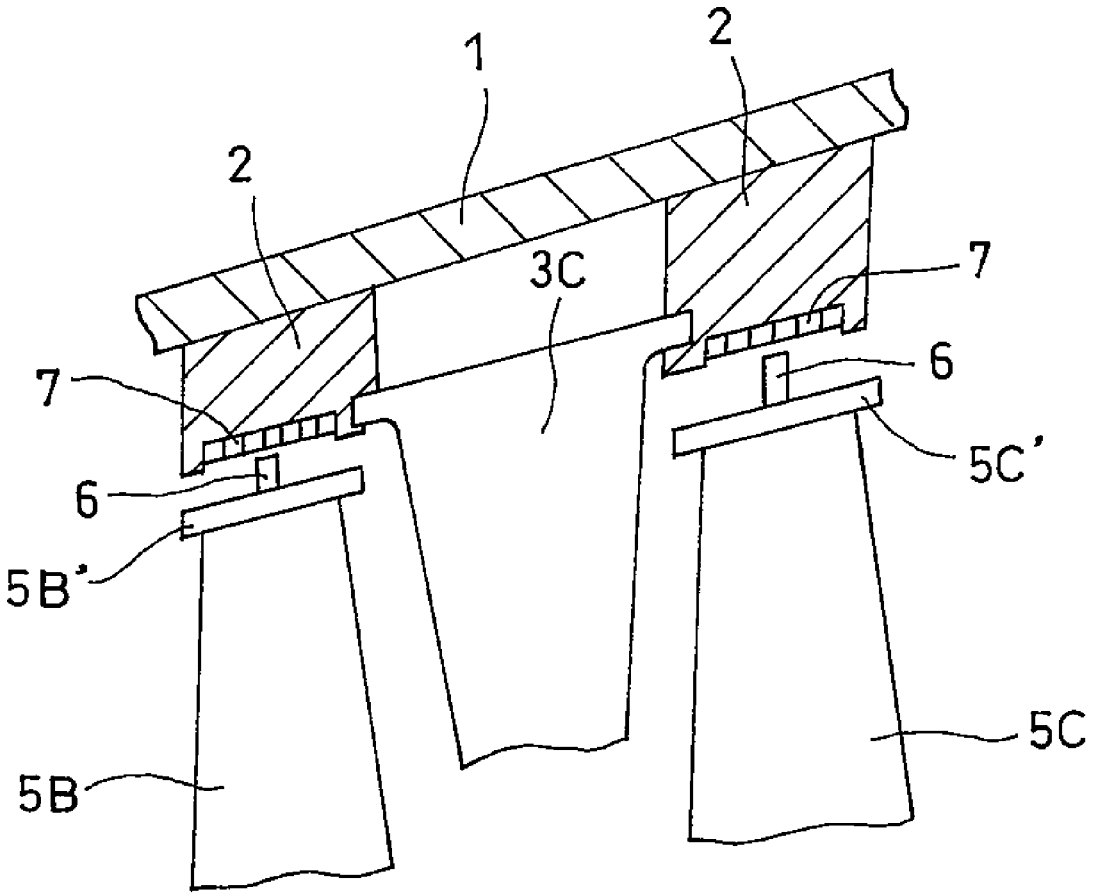
FIG. 2 is an enlarged view of an II-portion of FIG. 1, illustrating shrouds on a casing side, turbine blades, and seal fins.

FIG. 1 is a schematic view illustrating the overall configuration of a gas turbine according to the present invention, its upper part above a centerline being illustrated in longitudinal cross-section. FIG. 2 is an enlarged view of an II-portion of FIG. 1, illustrating shrouds on a casing side, turbine blades, and seal fins.

As illustrated in FIG. 1, a gas turbine 100 generally includes: a compressor 10 which compresses air sucked (from an X-direction) to generate compressed air; a combustor 20 which burns the compressed air from the compressor 10 together with fuel to generate high temperature and pressure combustion gas; and a turbine 30 which is driven by the combustion gas jetted from the combustor 20.

The power obtained at the turbine 30 is transmitted to and drives a generator and the like not shown connected to a rotating shaft 4 and is used as drive force for the compressor 10.

The turbine 30 has the rotating shaft 4 at the center of a casing 1 which partially houses the compressor 10 and the combustor 20. The rotating shaft 4 can be rotated around a rotational axis L1 (a longitudinal axis of the casing 1). A plurality of turbine blades 5A, 5B, 5C are mounted on the circumference of the rotating shaft 4.

Turbine stator vanes 3A, 3B, 3C are secured to the inner wall side of the casing 1. These turbine stator vanes 3A, 3B, 3C and the turbine blades 5A, 5B, 5C secured to the circumference of the rotating shaft 4 are alternately installed in the direction of the rotational axis L1 so as to configure respective stages. In the gas turbine 100 illustrated by way of example, the turbine 30 is a one-shaft turbine having three-stage blade rows and includes the first-stage stator vane 3A, the second-stage stator vane 3B, the third-stage stator vane 3C, the first-stage rotor blade 5A, the second-stage rotor blade 5B, and the third-stage rotor blade 5C. However, the gas turbine according to the present invention is not limited to the one-shaft gas turbine. The present invention may be applied to a two-shaft gas turbine having a high-pressure turbine and a low-pressure turbine. Further, the number of stages is not limited to the three stages and shall not be restrictive.

As illustrated in FIG. 2, a plurality of stages of shrouds 2 are annularly provided in the rotational direction of the turbine blades at respective positions between the turbine blades 5A-5C for all the stages and the casing 1 so as to define an outer circumferential wall of a passage for high temperature and pressure combustion gas in order to prevent the combustion gas from coming into direct contact with the casing 1.

These shrouds 2 are secured to the inner wall of the casing 1. The stator vanes 3A-3C are each integrally supported by the corresponding shrouds 2 of a plurality of stages.

The turbine blades 5A-5C are greater in blade length as they go toward the rear stages on the downstream side of the flow direction of the combustion gas, thus their strength against vibration stress or bending stress encountered when the turbine blades 5A-5C are subjected to the flow of the combustion gas tends to be lower as they go toward the rear stages. To improve such a tendency, for example, the second and third stage turbine blades 5B and 5C are provided with annular shroud covers 5B' and 5C', respectively, at their tips. In addition, the turbine blades 5B adjacent to each other in the rotational direction (the circumferential direction) thereof are integrated by the shroud cover 5B'. Similarly, the turbine blades 5C adjacent to each other in the rotational direction thereof are integrated by the shroud cover 5C'. Accordingly, the stiffness of the each blade row is enhanced.

It is desirable that clearances between the turbine blades 5A-5C and the corresponding shrouds 2 be narrow as much as possible in terms of the performance of the gas turbine. Seal fins 6 which generally linearly extend parallel to the rotational direction of the turbine blade are therefore provided on the radially outside surfaces of the shroud covers 5B', 5C' so as to project toward the corresponding shrouds 2.

The clearance between the seal fin 6 and the shroud 2 may be too small. In such a case, when the lengths of the turbine blades 5A-5C is increased due to the thermal expansion during operation, the seal fin 6 and the shroud 2 may be likely to come into contact with each other, which will probably lead to the breakage of or damage to the turbine blades 5A-5C. To prevent such breakage or damage, a honeycomb seal 7 is secured to the inner circumferential side of the shroud 2 so as to face the seal fin 6 with a clearance defined on the radial outside of the seal fin 6.

A detailed description will now be given of the honeycomb seal and a securing structure of the honeycomb seal to the shroud according to embodiments.

Honeycomb Seal and its Securing Structure According to a First Embodiment

Figure 3:
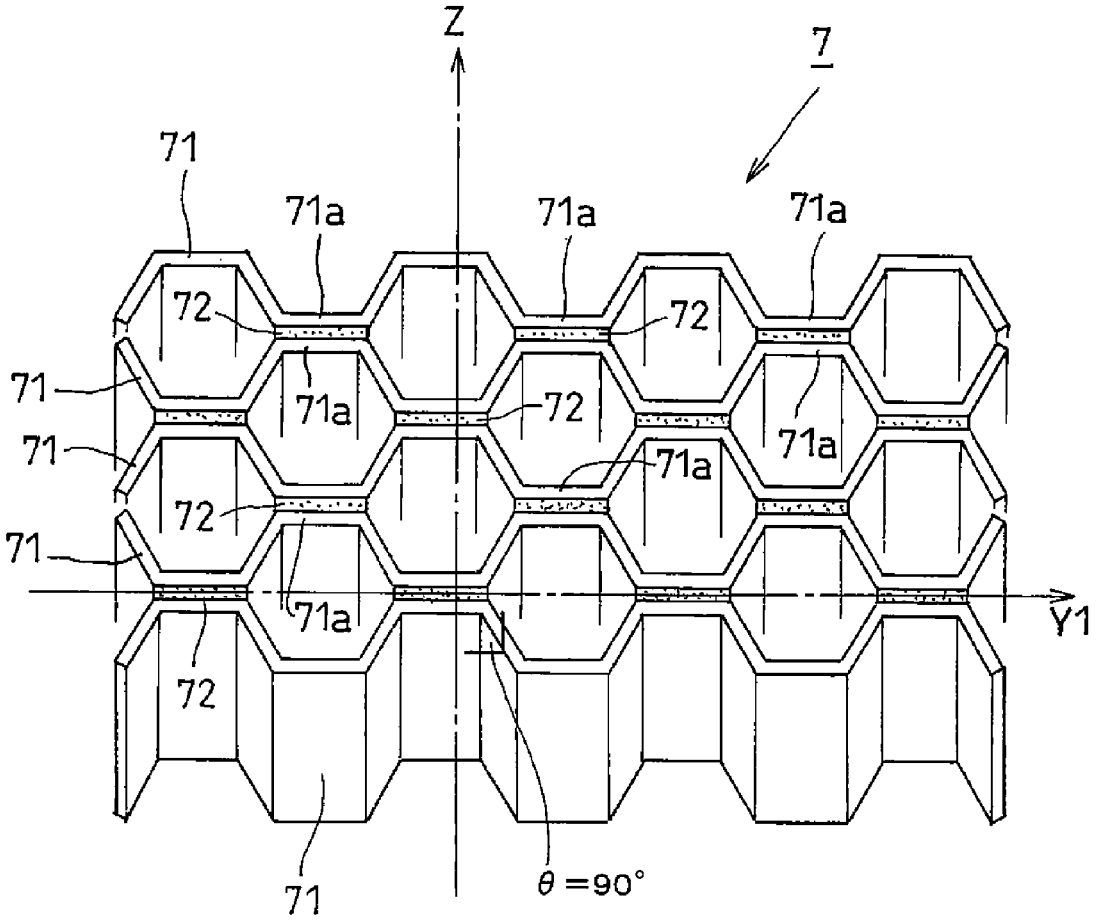
FIG. 3 is a schematic view illustrating a honeycomb seal and explains a first relation between the honeycomb seal and the rotational direction of a turbine blade (a honeycomb seal securing structure according to a first embodiment)

FIG. 3 is a schematic view illustrating a honeycomb seal and explains a first relation between the honeycomb seal and the rotational direction of a turbine blade (a honeycomb seal securing structure according to a first embodiment)

The honeycomb seal 7 has a hexagonal honeycomb structure configured in the following manner. Corrugated thin sheet metals 71 are each formed such that trapezoidal concavities and convexities are alternately continued. A plurality of the corrugated thin sheet metals 71 are joined to each other. Honeycomb shapes including approximately hexagonal voids and walls of node are continued to provide the hexagonal honeycomb structure. The hexagonal honeycomb structure is brazed to the shroud 2.

To manufacture the honeycomb seal 7, a thin sheet material is pressed to form a corrugated thin sheet metal 71. The corrugated thin sheet metals 71 are joined to each other through welding, brazing, or other methods to form the hexagonal honeycomb structure. Thereafter, a sheet-like brazing filler metal is held between the sticking surface of the shroud 2 and the honeycomb structure. These remaining in this state are heat-treated in a furnace to melt the sheet-like brazing filler metal. This heat treatment allows the molten sheet-like brazing filler metal to enter between the walls of node 71*a* of the corrugated thin sheet metals 71 adjacent to each other through minute gaps due to capillary action, the metal being to be hardened subsequently. Brazed places 72, formed between the walls of node 71*a*, ensure the stiffness of the honeycomb seal 7 which forms a honeycomb seal surface in contact with the seal fin 6.

In the brazed place 72, the brazing filler metal has penetrated to the tip of the wall of node 71*a* of the corrugated thin sheet metal 71 so as to firmly join the walls of node 71*a*, thereby achieving the maintenance of the shape and stiffness of the honeycomb seal 7.

As illustrated in FIG. 3, a setting angle θ between the longer direction (the Y1 direction and also the longer direction of the brazed place 72) of the wall of node 71*a* and the rotational direction (the Z direction) of the turbine blades 5A-5C is set to 90 degrees in the formation in which the honeycomb seal 7 is secured to the shroud 2.

Figure 8:
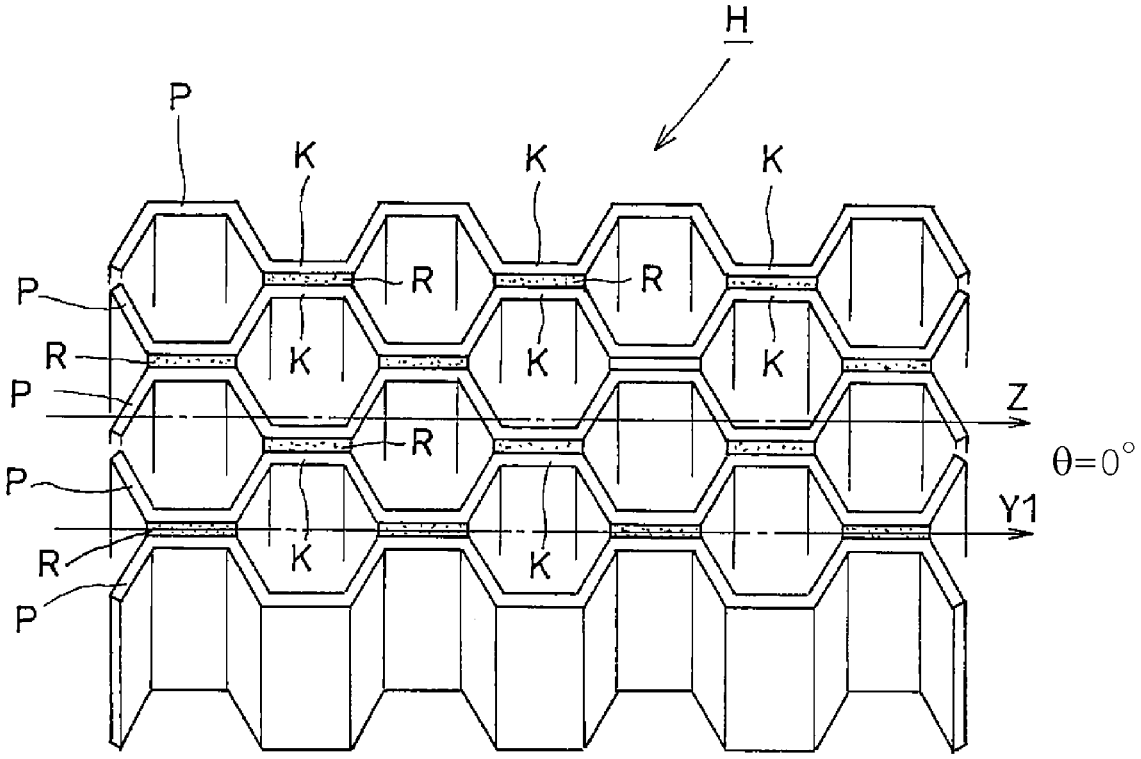
FIG. 8 is a view illustrating a honeycomb seal applied in FIG. 7 and explains a relation between the honeycomb seal and the rotational direction of the turbine blade.

The following formation will be easily understood through comparison with the securing formation of the conventional honeycomb seal H illustrated in FIG. 8. The seal fin 6 on the tip of the turbine blade comes into contact with the honeycomb seal 7 to abrade the honeycomb seal 7 when the securing formation of the honeycomb seal 7 illustrated in FIG. 3 is applied. At this time, the seal fin 6 passes the two walls of node 71*a* which are a part of the honeycomb seal 7 in the thickness direction of the walls and passes the brazed place 72 between the walls of node 71*a* in the thickness direction of the brazed place 72.

In short, the seal fin 6 passes the walls of node 71*a* at the shortest distance and passes the brazed place 72 at the shortest distance as well.

As described above, the seal fin 6 abrades the shortest portions of the walls of node 71*a* and brazed place 72 of the honeycomb seal 7. In particular, the seal fin 6 abrades the shortest portion of the hard brazed place 72. A problem is accordingly effectively solved in which the seal fin 6 is broken or damaged at the time of abrading the honeycomb seal 7.

Incidentally, the illustrated securing structure of the honeycomb seal 7 is a simple structure improved after modification of the arrangement mode of the honeycomb seal 7. The manufacturing costs of the turbine will not be increased due to the improved structure for this reason.

Honeycomb Seal Securing Structure According to a Second Embodiment

Figure 4:
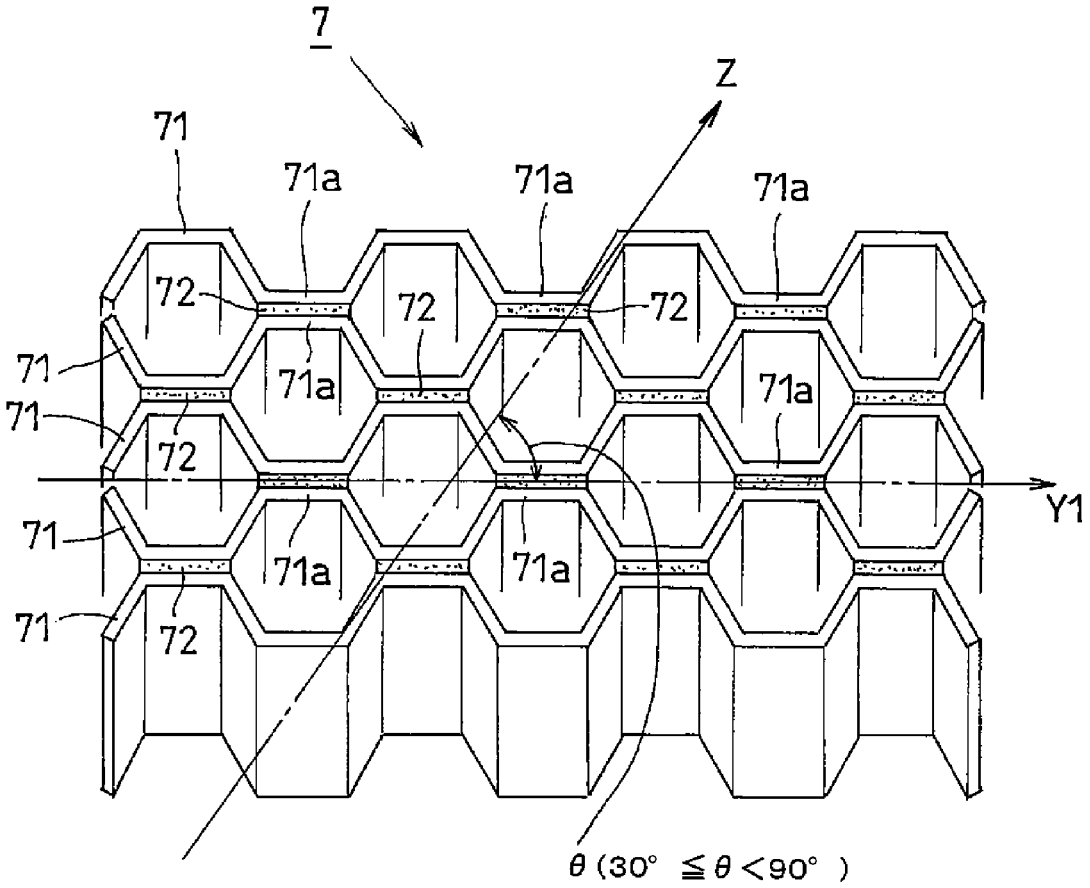
FIG. 4 is a view for explaining a second relation between a honeycomb seal and the rotational direction of a turbine blade (a honeycomb seal securing structure according to a second embodiment)

FIG. 4 is a view for explaining a second relation between a honeycomb seal and the rotational direction of a turbine blade (a honeycomb seal securing structure according to a second embodiment).

The arrangement formation of the honeycomb seal illustrated in FIG. 4 is such that a setting angle θ between the longer direction (the Y1 direction) of the wall of node 71*a* and the rotational direction (the Z direction) of the turbine blades 5A-5C is set at a range from 30 degrees to less than 90 degrees.

A length in which the walls of node 71*a* and the brazed place 72 are abraded by the seal fin 6 is greater than that in the case where the setting angle θ is 90 degrees. However, the study of the present inventors shows that if the setting angle θ is within a range equal to or greater than 30 degrees, an effect of preventing the breakage of the seal fin 6 can sufficiently be attained.

Honeycomb Seal Securing Structure According to a Third Embodiment

Figure 5:
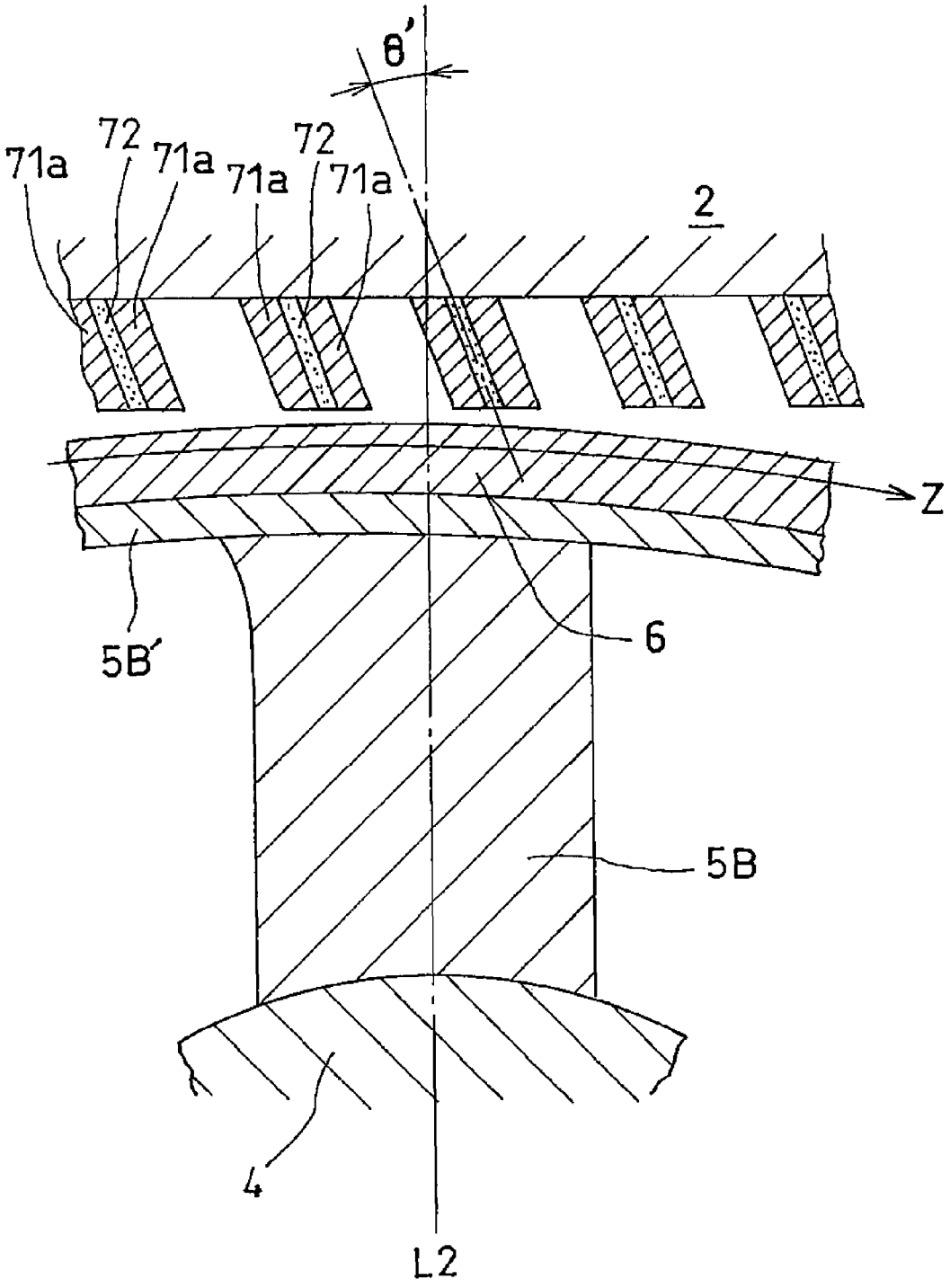
FIG. 5 is a view for explaining a honeycomb seal securing structure according to a third embodiment.

FIG. 5 is a view for explaining a honeycomb seal securing structure according to a third embodiment.

The securing structure of the honeycomb seal illustrated in FIG. 5 is as follows: for example, as illustrated in FIGS. 3 and 4, a setting angle θ between the longer direction (the Y1 direction) of the wall of node 71*a* and the rotational direction (the Z direction) of the turbine blades 5A-5C is set at a range from 30 to 90 degrees. In addition to this securing structure of the honeycomb seal 7, the wall of node 71*a* and the brazed place 72 are tilted at a tilt angle θ' in a range between 15 degrees and 45 degrees in the rotational direction (the Z direction) of the turbine blade with respect to a vertical axis L2 perpendicular to the rotating shaft 4.

The study of the present inventors shows that since the honeycomb seal 7 has the tilt angle tilted in the rotational direction of the turbine blade in such an angle range, a load received by the seal fin 6 can further be reduced when the seal fin 6 abrades the honeycomb seal 7. The effect of preventing the breakage of the seal fin 6 can further be enhanced.

Seal Fins According to Other Embodiments

Figure 6A:
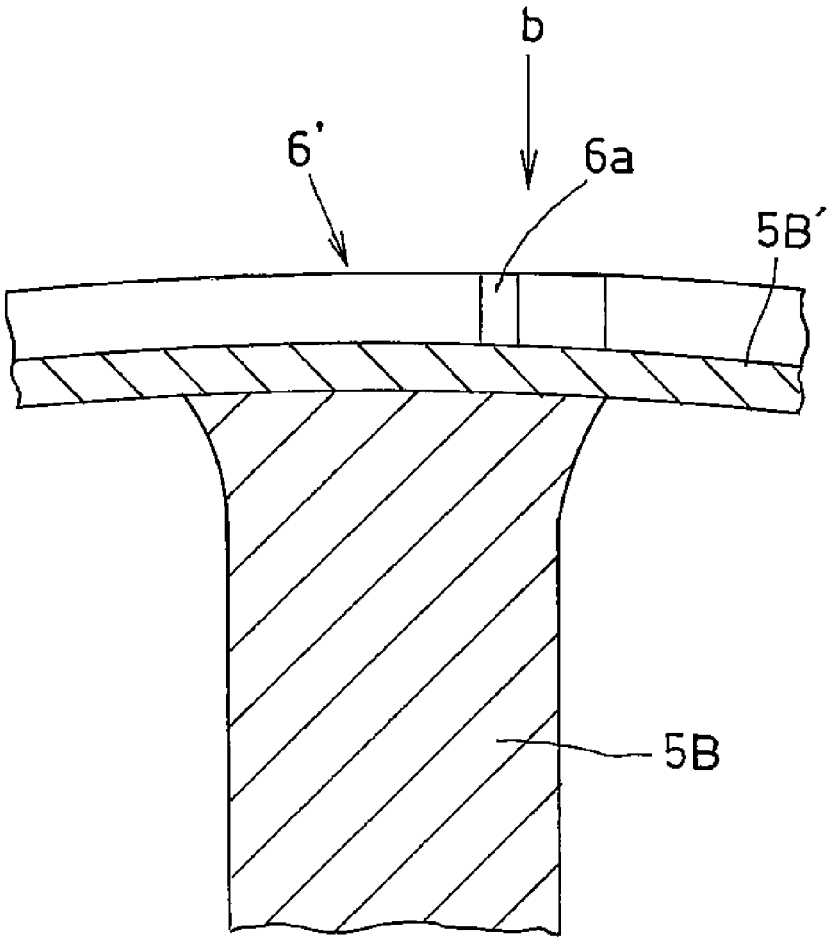
FIG. 6A is a side view for explaining a seal fin according to another embodiment.
Figure 6B:
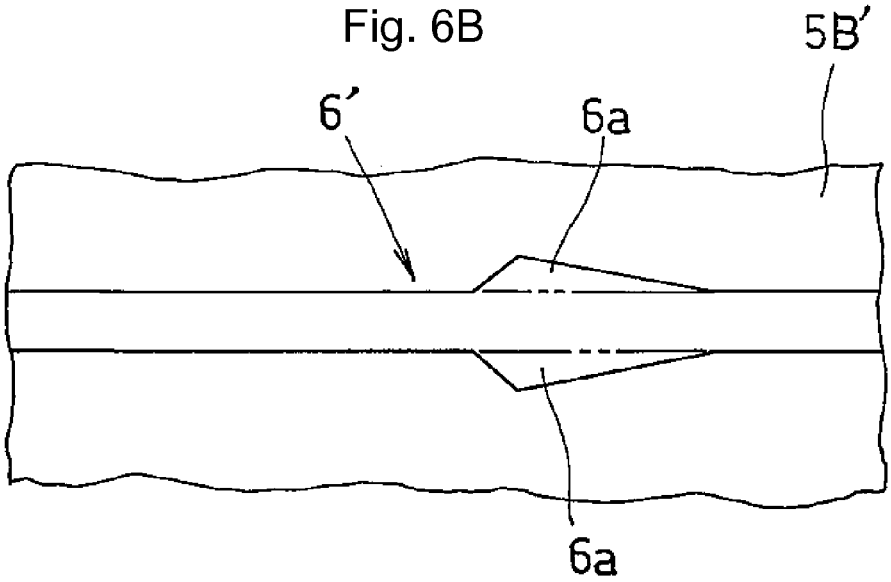
FIG. 6B is a view illustrating the seal fin as viewed from arrow (b) in FIG. 6A.
Figure 7:
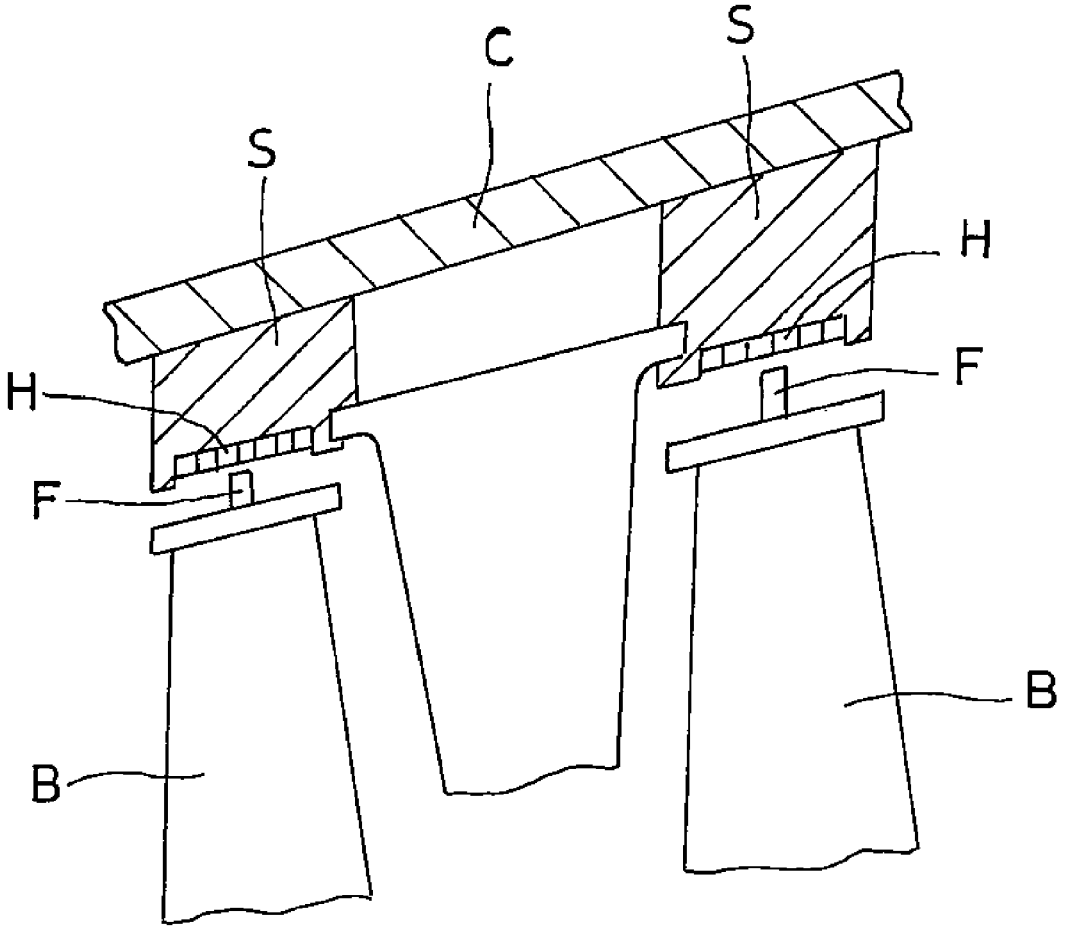
FIG. 7 is a view illustrating shrouds on a casing side, turbine blades and seal fins in a conventional gas turbine.

Descriptions are next given of seal fins of other embodiments. FIGS. 6A and 6B are views for explaining a seal fin of another embodiment, FIG. 6A being a side view illustrating the seal fin, FIG. 6B being a view illustrating the seal fin as seen from arrow "b" in FIG. 6A.

As illustrated in FIGS. 6A and 6B, a seal fin 6' is partially provided with thickened portions 6*a* formed by a hard material overlaid (the hard material being an abrasion-resistant alloy or ceramics, for example)

The thickened portions 6*a* made of the hard material are provided to project leftward and rightward from the side walls of the seal fin 6'. The abradability of the honeycomb seal 7 can further be enhanced in this manner.

Although an illustration is omitted, a seal fin may be applied that is further provided with a projection projecting upward from the upper end surface of the seal fin depicted in FIG. 6A.

A seal fin may be formed with a coating layer made of a hard material on the whole circumference thereof.

[Experiments to Confirm the Effect of the Honeycomb Seal Constituting a Part of the Gas Turbine and its Securing Structure According to the Present Invention, and the Results of the Experiments]

The inventors conducted experiments in the following manner. The securing structure of the honeycomb seal illustrated in FIG. 3; specifically, the securing structure of the formation was manufactured in which a setting angle θ between the longer direction of the wall of node of the corrugated thin sheet metal and the rotational direction of the turbine blade was set at 90 degrees. In addition, a load acting on the seal fin when the honeycomb seal was abraded was measured.

The conventional securing structure illustrated in FIG. 8 was also manufactured as a comparative example. The same experiment was performed and a load acting on the seal fin at that time was measured.

The results of the comparison between both the measurement values show that the maximum load acting on the seal fin in the securing structure illustrated in FIG. 3 is about ½ of the maximum load acting on the seal fin in the comparative example illustrated in FIG. 8. It is verified that the effect of enhancing abradability of the honeycomb seal and the effect of preventing the breakage of the seal fin can sufficiently be expected.

The present inventors further conducted an experiment in the following manner. A honeycomb seal was manufactured which had the structure having the tilt angle illustrated in FIG. 5 in addition to the securing structure illustrated in FIG. 3. In addition, the maximum load acting on the seal fin was measured.

The honeycomb seals whose tilt angle θ' was sequentially varied from 15 to 45 degrees are manufactured in this experiment. Moreover, the maximum loads acting on the seal fins when the respective honeycomb seals were applied were measured.

The result shows that if the setting angle θ shown in FIG. 3 is 90 degrees and the tilt angle θ' is equal to zero, the maximum load acting on the seal fin is approximately ½ of the conventional structure illustrated in FIG. 8 as described above. Meanwhile, If the tilt angle θ' is 15 degrees, the maximum load acting on the seal fin can further be reduced by approximately 5%. If the tilt angle θ' is 45 degrees, the maximum load acting on the seal fin can further be reduced by approximately 30%.

It is confirmed through the experimental results that the application of the illustrated honeycomb seal securing structure can produce the effect of enhancing abradability of the honeycomb seal and the effect of preventing the breakage of the seal fin.

What is claimed is:

1. A gas turbine comprising:

a compressor, a combustor, and a turbine which includes a honeycomb seal disposed so as to be secured to a casing side in a clearance between a casing and a turbine blade rotating around a rotating shaft extending in a longitudinal direction of the casing, and a seal fin provided on an end face of the turbine blade facing the honeycomb seal, the seal fin extending in a direction perpendicular to the rotating shaft, wherein the honeycomb seal is formed by a plurality of corrugated sheet metals overlapped with each other, the honeycomb seal having nodes of walls where the corrugated sheet metals overlap with each other, the walls of the nodes being brazed with each other, each of the corrugated sheet metals having a trapezoid alternately continued, a longer direction of each wall of the nodes of the honeycomb seal is angled with respect to a rotational direction of the turbine blade, each wall of the nodes is tilted at a tilt angle in the rotational direction of the turbine blade with respect to a vertical axis perpendicular to the rotating shaft such that an inner peripheral end of the wall is positioned behind of an outer peripheral end of the wall in the rotational direction, and the tilt angle is within a range of 15 to 45 degrees.

2. The gas turbine according to claim 1, wherein the longer direction of each wall of the nodes of the honeycomb seal is angled with respect to the rotational direction of the turbine blade in a range from 30 to 90 degrees.

3. The gas turbine according to claim 2, wherein the longer direction of each wall of the nodes of the honeycomb seal is angled with respect to the rotational direction of the turbine blade at 90 degrees.

4. The gas turbine according to claim 1, wherein the seal fin has a thickened portion formed by overlaying an abrasion-resistant alloy or ceramics.

5. The gas turbine according to claim 1, wherein an abrasion-resistant alloy or ceramics is coated on a surface of the seal fin.

* * * * *